US008763657B2

(12) United States Patent
Newingham

(10) Patent No.: US 8,763,657 B2
(45) Date of Patent: Jul. 1, 2014

(54) APPARATUS FOR CARD ARRANGEMENT

(75) Inventor: Daniel Martin Newingham, Greensburg, PA (US)

(73) Assignee: Daniel Martin Newingham, Greensburg, PA (US)

( * ) Notice: Subject to any disclaimer, the term of this patent is extended or adjusted under 35 U.S.C. 154(b) by 14 days.

(21) Appl. No.: 13/546,267

(22) Filed: Jul. 11, 2012

(65) Prior Publication Data

US 2013/0014867 A1 Jan. 17, 2013

Related U.S. Application Data

(60) Provisional application No. 61/508,560, filed on Jul. 15, 2011.

(51) Int. Cl.
*A45C 11/18* (2006.01)

(52) U.S. Cl.
USPC ..... 150/147; 150/131; 150/146

(58) Field of Classification Search
USPC ..... 150/131–146, 147
See application file for complete search history.

(56) References Cited

U.S. PATENT DOCUMENTS

| | | | | | |
|---|---|---|---|---|---|
| 2,011,879 | A | * | 8/1935 | Stein | 190/109 |
| 2,161,015 | A | * | 6/1939 | Buxton | 281/17 |
| 3,360,027 | A | * | 12/1967 | Price | 150/132 |
| 3,856,063 | A | | 12/1974 | Dengel | |
| D259,749 | S | * | 7/1981 | McDonald | D3/247 |
| 4,907,634 | A | * | 3/1990 | Yoo | 150/135 |
| 5,230,627 | A | * | 7/1993 | Todd | 434/109 |
| 7,730,917 | B2 | | 6/2010 | Hui | |

* cited by examiner

*Primary Examiner* — Tri Mai

(57) ABSTRACT

A wallet (apparatus for card arrangement) that maintains card arrangement in a secure position while allowing the user to more quickly and efficiently insert and remove their cards by exposing a greater card surface area. An apparatus for card arrangement comprises a base wallet (202) bound to small and large inner pocket partitions (204 and 206) covered by a top cover (212). Furthermore the invention increases the life of the wallet, effectively decreasing the cost of ownership over the life of the wallet.

2 Claims, 6 Drawing Sheets

APPARATUS FOR CARD ARRANGEMENT

CROSS-REFERENCE TO RELATED APPLICATIONS

This application claims benefit of provisional patent application Ser. No. 61/508,560 filed 2011 Jul. 15 by present inventor.

FEDERALLY SPONSORED RESEARCH

None

SEQUENCE LISTING

None

BACKGROUND

The present invention relates to a wallet, particularly to an apparatus for card arrangement used in wallets (or called billfolds, notebooks, handbooks) or any other kind of personal card storage, transportation, or management container.

At present some conventional apparatus for card arrangement are commonly set in all kinds of wallets. Referring to FIG. 1, as an example, a conventional apparatus consist of a base wallet 102 and a number of stepwisely overlapped pocket partitions 104 to form the tops of the card pockets. A flimsy liner material 106 extends below the pocket partitions 104 and at the bottom is bound to the liner material of the pocket adjacent to it at pocket bottom rim 112. The front most pocket that is fully exposed is often made out of a whole piece of leather 108. All pockets are bound to the base wallet by the outer rim 110.

This conventional apparatus has two main drawbacks:

1) Due to the stepwisely overlapping pockets only a limited surface area of the card can be exposed without grossly increasing the height of the wallet. I have found that this limited surface area of card exposure makes it difficult for a user to discern and get a strong grip on the card they would like to select and remove from the pocket. Thus making user interaction with his/her cards inefficient.
2) The lining material 106 used to limit the overall thickness of the wallet easily tears and forces the user to repair or replace the wallet.

U.S. Pat. No. 7,730,917 B2 to Hui attempts to overcome the aforementioned drawbacks with an accordion file folder style apparatus for card receival. While this apparatus eliminates the need for a lining material it restricts the accessibility to the cards. The user of U.S. Pat. No 7,730,917 B2 an apparatus for card receival cannot access his/her cards without fully opening the wallet. This makes it cumbersome and inefficient for the user to access the cards.

Hence it is desired to provide an apparatus for card arrangement which can overcome the foregoing drawbacks of the prior art.

SUMMARY

An improved apparatus for card arrangement has material such as leather (but other materials are also suitable) cut and bound together to form pockets for card arrangement. The material is cut and bound together in such a way that allows the user to efficiently insert or remove cards from the pockets.

Accordingly several advantages are to provide an improved apparatus for card arrangement, to provide a means of accessing cards quickly and efficiently, to provide an apparatus for card arrangement that is durable, and to provide an apparatus for card arrangement that securely holds cards in place. Still further objects and advantages will become apparent from a study of the following description and the accompanying drawings.

DRAWINGS

DETAILED DESCRIPTION

Figure 1:
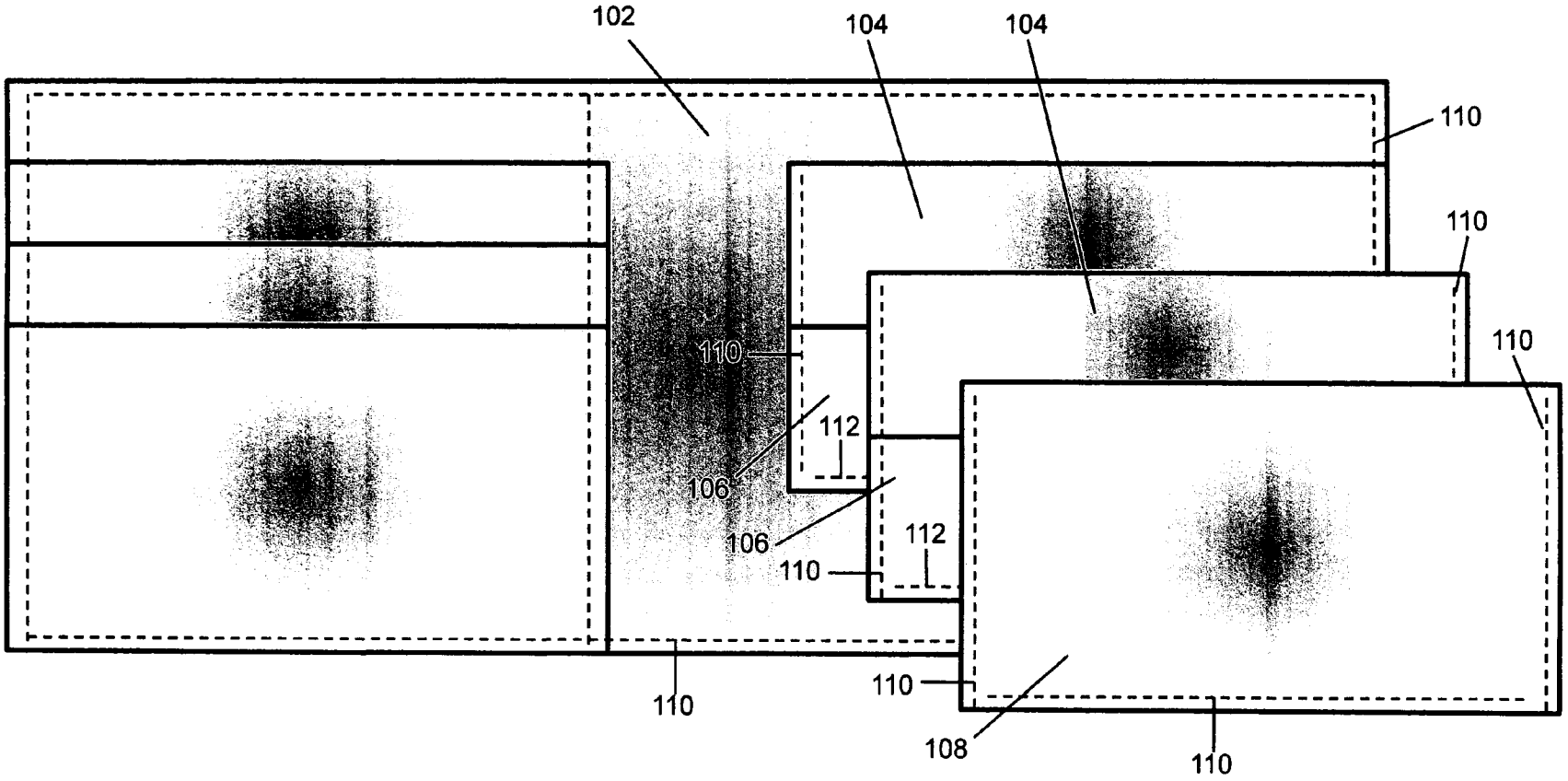
FIG 1 (PRIOR ART)
FIG. 1 is an exploded assembly view of a conventional apparatus for card arrangement in a wallet.
Figure 2:
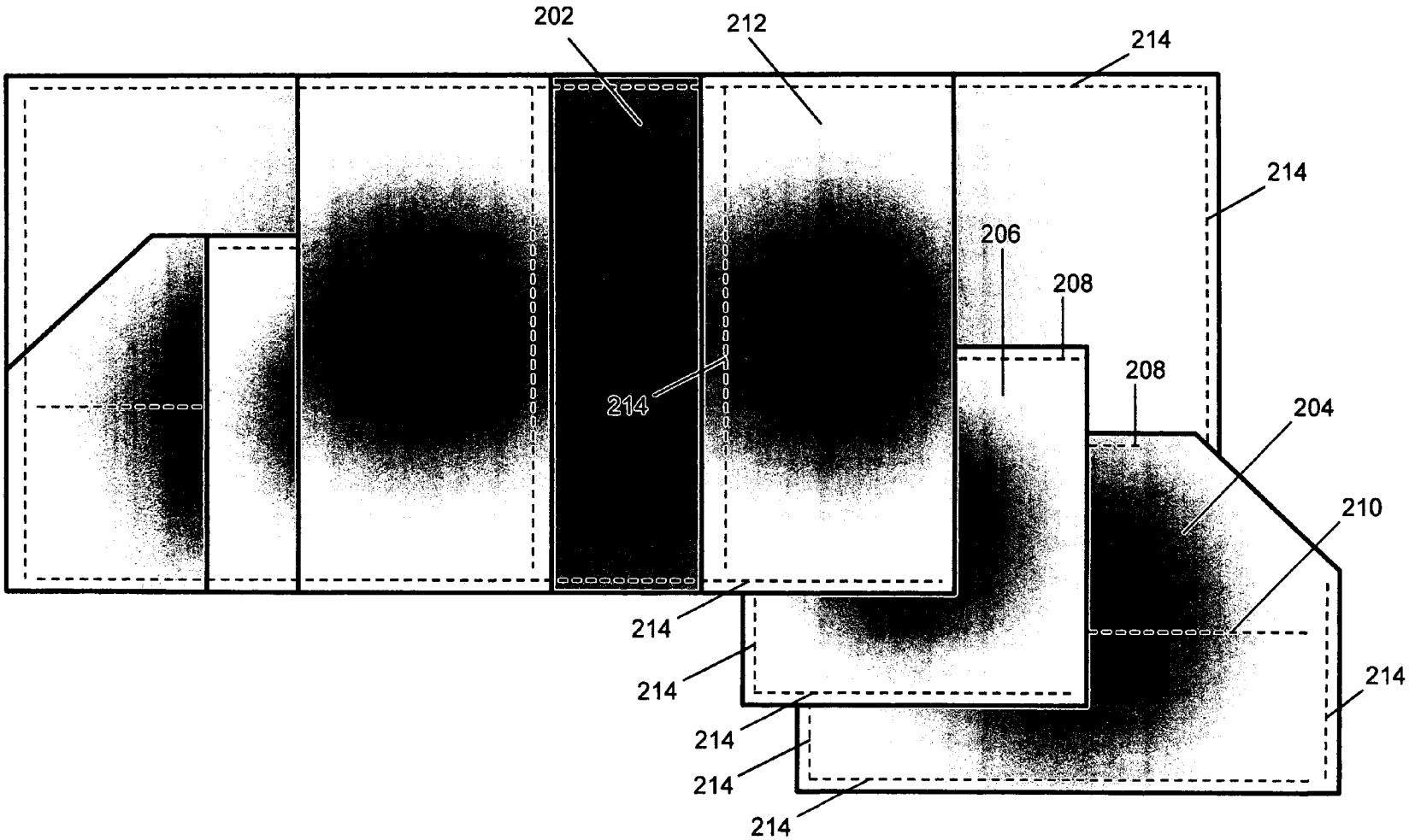
FIG. 2 is an exploded assembly view of an apparatus for card arrangement of the invention in a wallet.

FIG. 2 is an exploded assembly view of an apparatus for card arrangement of the invention in a wallet, showing the base wallet 202, the large inner pocket partition 204, the small inner pocket partition 206, the inner pocket edge 208, the bottom edge of top back pocket 210, the top cover 212, and the outer rim 214. The base wallet 202, the large inner pocket partition 204, the small inner pocket partition 206, and the top cover 212 are cut from a material such as leather (but other materials are also suitable). The inner pocket edge 208, the bottom edge of top back pocket 210, and the outer rim 214 are created using a binding material such as nylon thread (but other materials are also suitable). Assembly of this embodiment is achieved by first binding small inner pocket partition 206 to large inner pocket partition 204 along inner pocket edge 208. Large inner pocket partition 204 is then bound to base wallet 202 along bottom edge of top back pocket 210. Finally top cover 212 is bound to base wallet 202, small inner pocket partition 206, and large inner pocket partition 204 along outer rim 214.

Figure 3:
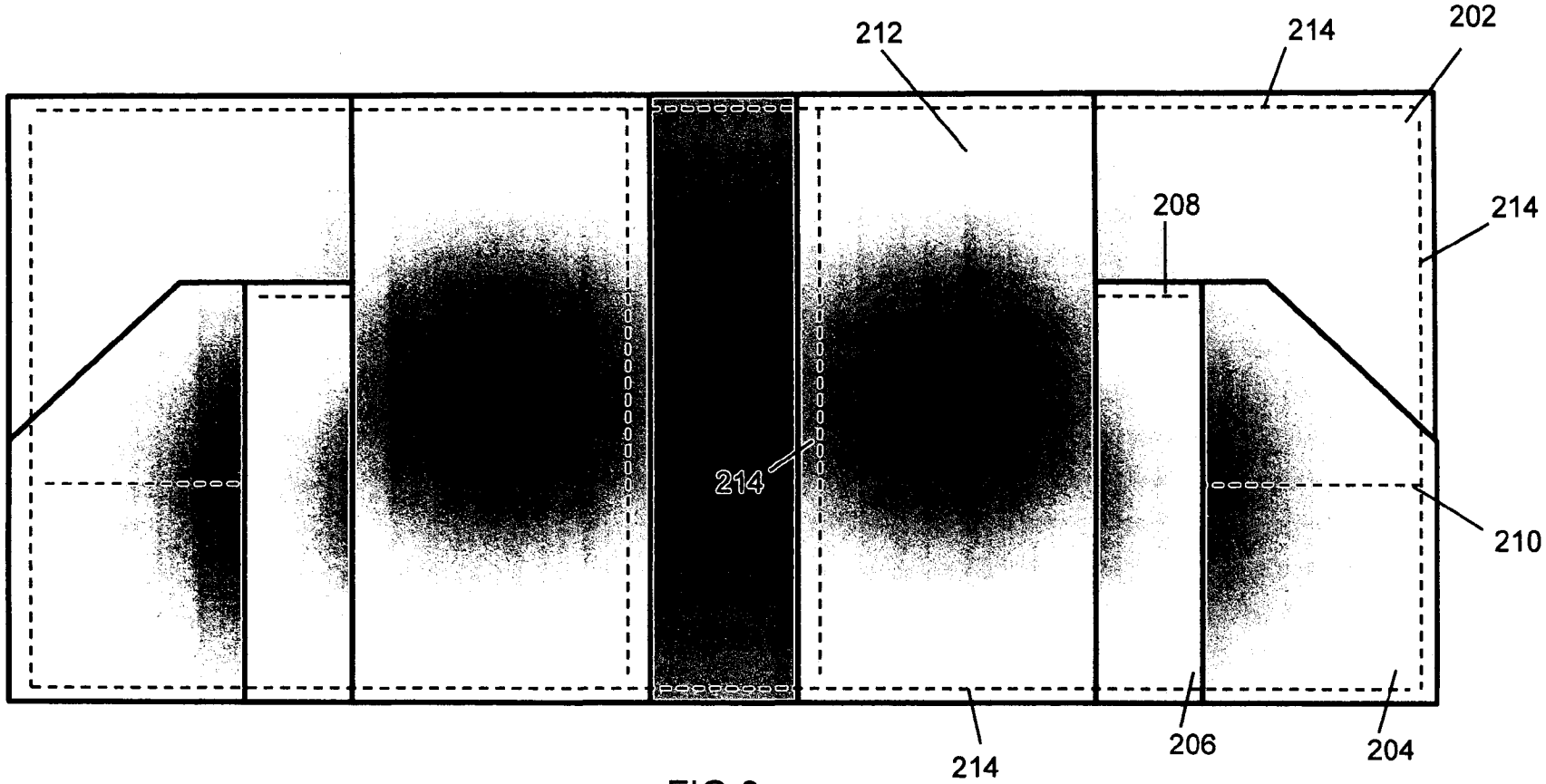
FIG. 3 is a flat view of an apparatus for card arrangement of the invention in a wallet before cards are received in the pockets.

FIG. 3 is a flat view of an apparatus for card arrangement of the invention in a wallet before cards are received in the pockets, showing the base wallet 202, the large inner pocket partition 204, the small inner pocket partition 206, the inner pocket edge 208, the bottom edge of top back pocket 210, the top cover 212, and the outer rim 214. Depending on the width of top cover 212, small inner pocket partition 206 may be completely hidden. However to aid in illustration of card receival in FIGS. 4-6 the edge of small inner pocket partition 206 is exposed in this embodiment.

Figure 4:
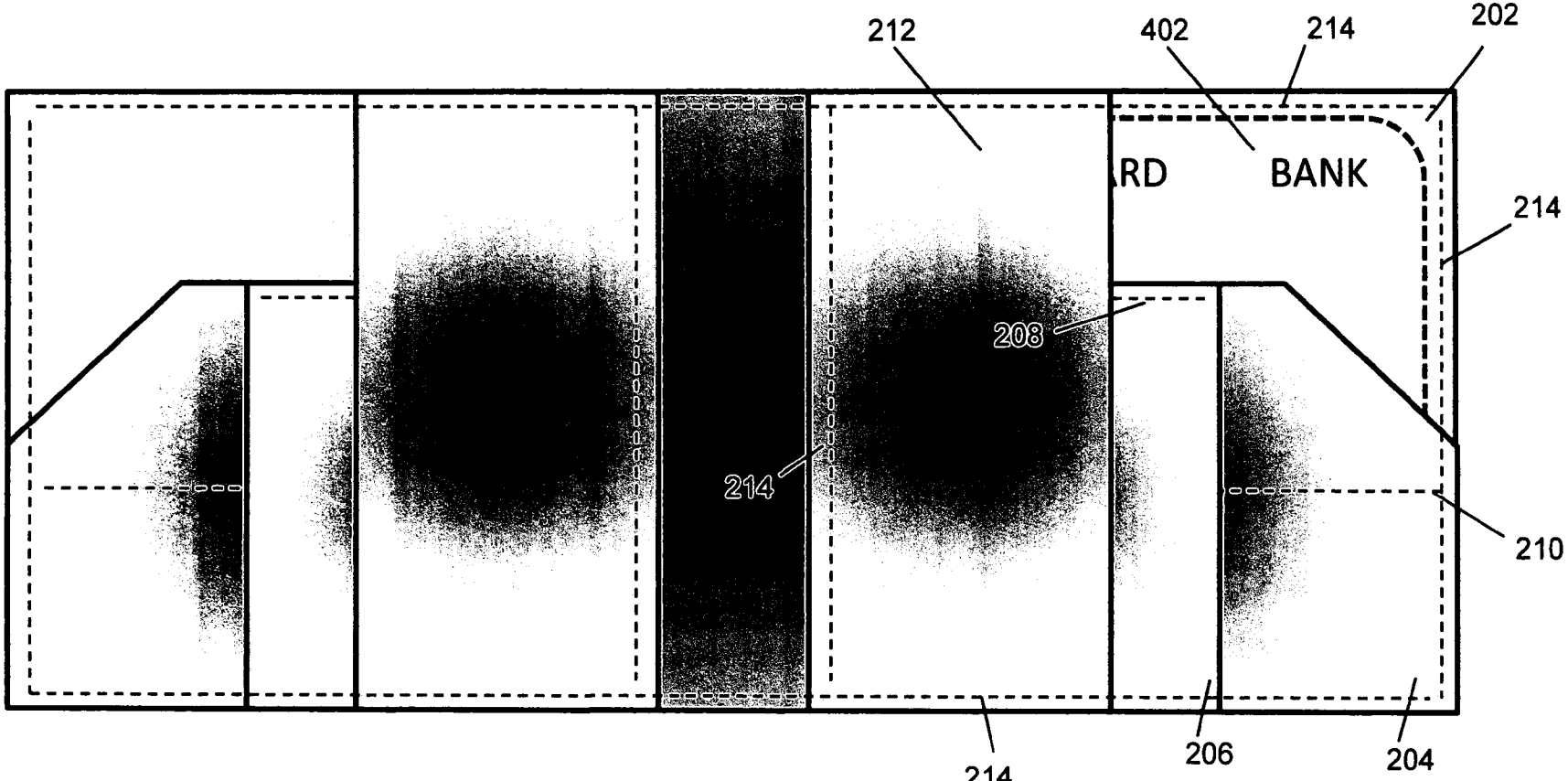
FIG. 4 is a flat view of an apparatus for card arrangement of the invention in a wallet after a card is received in the top back pocket.

FIG. 4 is a flat view of an apparatus for card arrangement of the invention in a wallet after a card is received in the top back pocket, showing the base wallet 202, the large inner pocket partition 204, the small inner pocket partition 206, the inner pocket edge 208, the bottom edge of top back pocket 210, the top cover 212, the outer rim 214 and card 402. Card 402 in the top back pocket is inserted in the space on top of base wallet 202 and behind large inner pocket partition 204. The bottom edge of the pocket for card 402 ends at the bottom edge of top back pocket 210.

Figure 5:
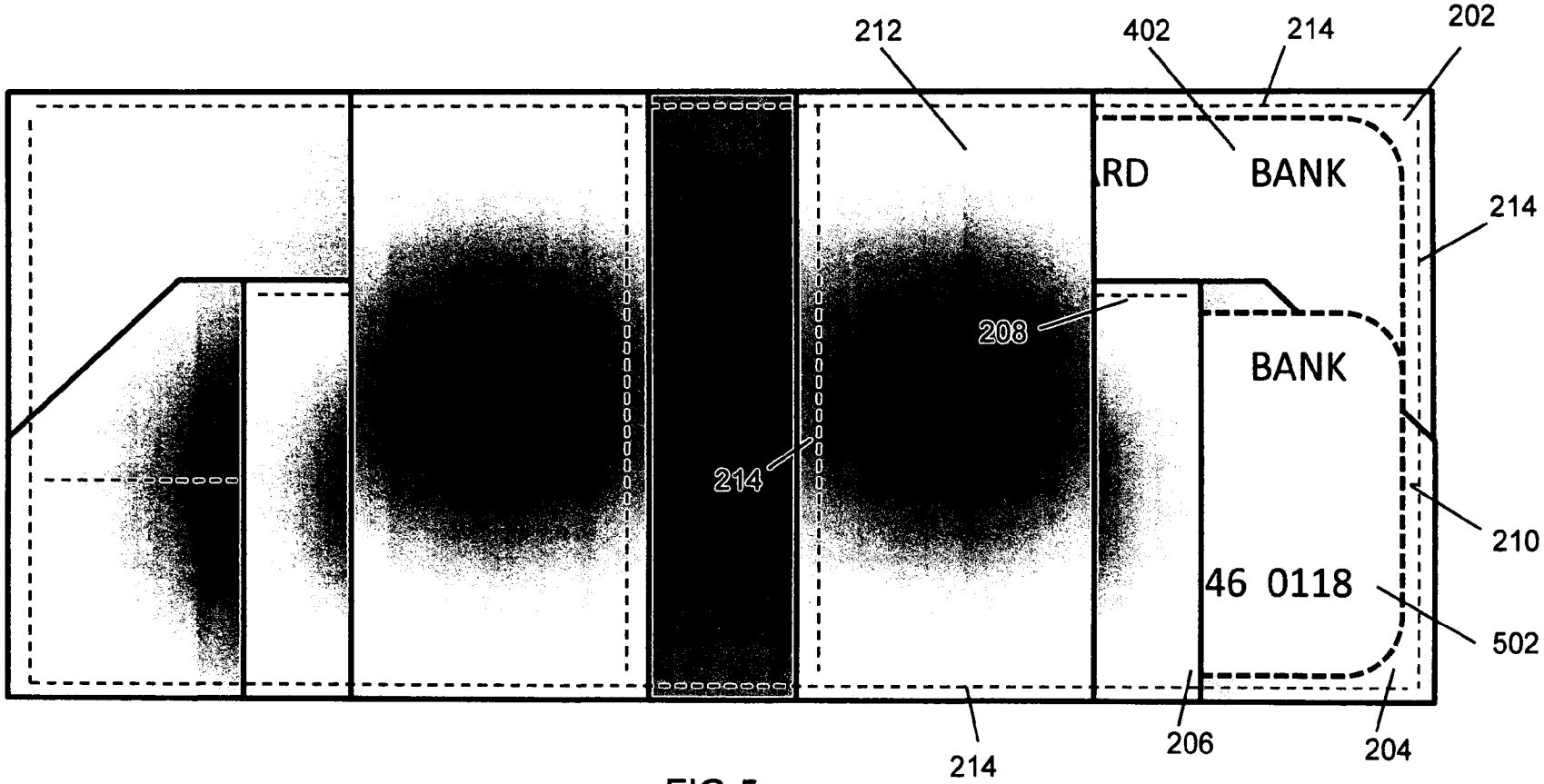
FIG. 5 is a flat view of an apparatus for card arrangement of the invention in a wallet after a card is received in the top back pocket and the bottom middle pocket.

FIG. 5 is a flat view of an apparatus for card arrangement of the invention in a wallet after a card is received in the top back pocket and the bottom middle pocket, showing the base wallet 202, the large inner pocket partition 204, the small inner pocket partition 206, the inner pocket edge 208, the bottom edge of top back pocket 210, the top cover 212, the outer rim 214, card 402 and card 502. Card 502 in the bottom middle pocket is inserted in the space on top of large inner pocket partition 204 and behind small inner pocket partition 206.

Figure 6:
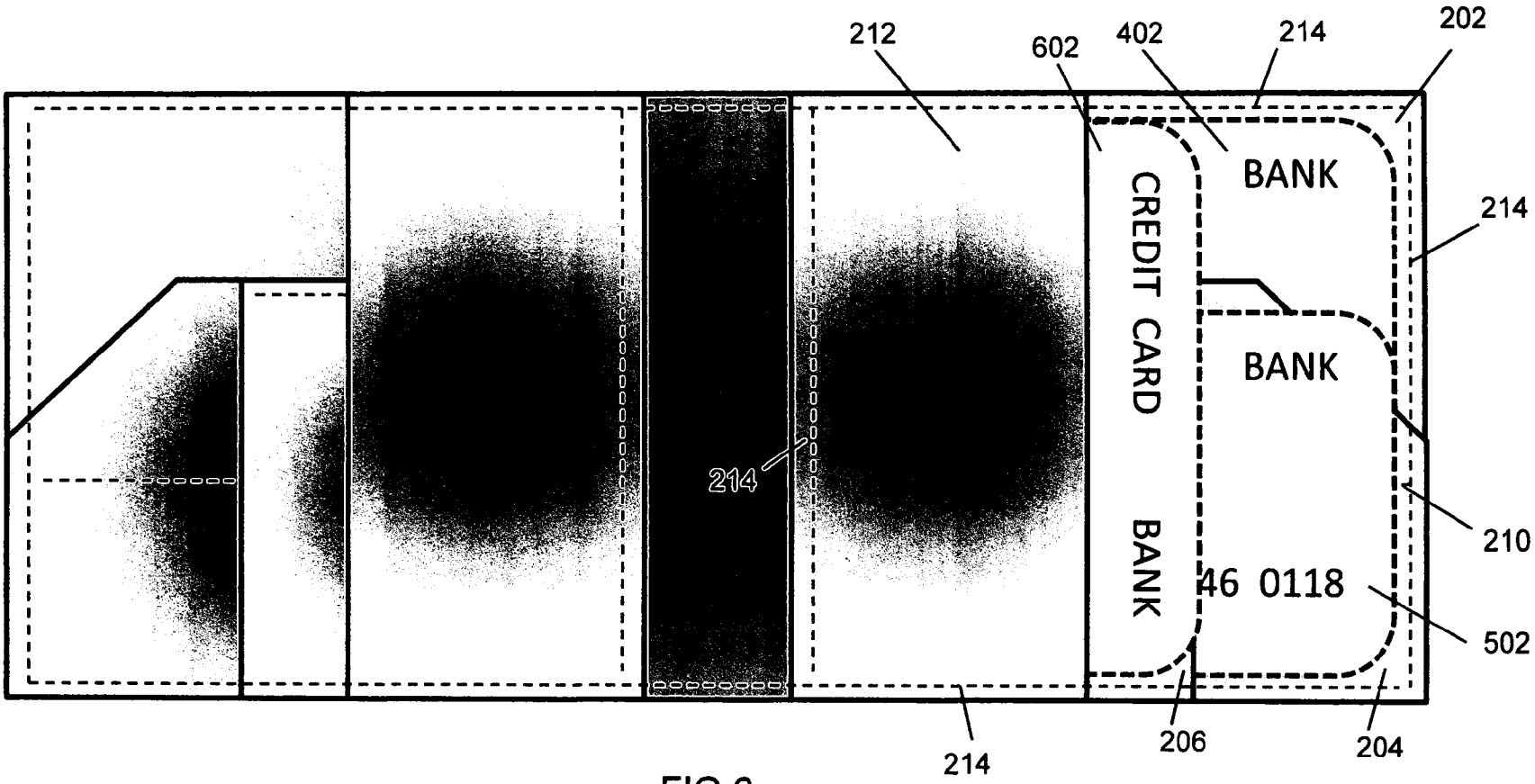
FIG. 6 is a flat view of an apparatus for card arrangement of the invention in a wallet after a card is received in the top back pocket, the bottom middle pocket, and the center front pocket.

FIG. 6 is a flat view of an apparatus for card arrangement of the invention in a wallet after a card is received in the top back pocket, the bottom middle pocket, and the center front pocket, showing the base wallet 202, the large inner pocket partition 204, the small inner pocket partition 206, the bottom edge of top back pocket 210, the top cover 212, the outer rim 214, card 402, card 502, and card 602. Card 602 in the center front pocket is inserted in the space on top of small inner pocket partition 206 and behind top cover 212.

REFERENCE NUMBERALS

102 base wallet
104 inner pocket partition
106 liner
108 outer pocket cover
110 outer rim
112 pocket bottom rim
202 base wallet
204 large inner pocket partition
206 small inner pocket partition
208 inner pocket edge
210 bottom edge of top back pocket
212 top cover
214 outer rim
402 card
502 card
602 card

OPERATION

In operation one uses the invention in a normal manner like inserting and removing cards from regular wallet card pockets. When the user interacts with the apparatus for card arrangement four unexpected effects improves the experience:

1) The apparatus for card arrangement (202, 206, 208, 210, 212, 214) allows cards to be stored horizontally and inserted or removed in a left to right (or right to left) motion. This exposes a large surface area of the cards when fully inserted. This makes it easier for the user to identify, grip, and efficiently remove a card.
2) The apparatus for card arrangement (202, 206, 208, 210, 212, 214) allows cards to be inserted or removed horizontally from the left or right edge of the wallet. This allows the user to access their cards more quickly and efficiently by only partially opening the wallet.
3) The arrangement of cards in the apparatus for card arrangement (202, 206, 208, 210, 212, 214) is spread out which maintains a thin profile for the wallet. This also eliminates the need for a lining material to avoid overthickness of the overlapped pockets. I have found lining materials to quickly wear out and fall apart, hurting the life of a wallet. The apparatus for card arrangement has no lining materials, which makes the apparatus for card arrangement strong and durable. A user of prior art with lining material that wears out will have to replace or repair his/her wallet more frequently than a user of a wallet with the apparatus for card arrangement. Therefore the user of a wallet with the apparatus for card arrangement will enjoy a lower cost of wallet ownership over the life of the wallet.
4) Although cards in the apparatus for card arrangement (202, 206, 208, 210, 212, 214) appear to be dangling out of their pockets, which aids in quick and efficient user interaction with the cards, the assembly of the apparatus for card arrangement holds all cards tightly and securely.

The invention claimed is:

1. An apparatus for card arrangement comprising:

a top piece which will cover roughly the left half of a card in portrait orientation when said card in portrait orientation is inserted in said apparatus for card arrangement, a small inner piece which underlies roughly the bottom half of said card in portrait orientation, and overlies roughly the left half of a bottom card in landscape orientation when said bottom card in landscape orientation is inserted in said apparatus for card arrangement, said top and small inner pieces being joined at the left and bottom outer edges of said apparatus for card arrangement, a large inner piece which underlies said bottom card in landscape orientation when said bottom card in landscape orientation is inserted in said apparatus for card arrangement, and overlies roughly the bottom half of a top card in landscape orientation when said top card in landscape orientation is inserted in said apparatus for card arrangement, said top, small inner, and large inner pieces being joined at the left and bottom outer edges of said apparatus for card arrangement, said large and small inner pieces being joined at the top edge of said large and small inner pieces, a bottom piece which underlies said large inner piece and said top card in landscape orientation when said top card in landscape orientation is inserted in said apparatus for card arrangement, said bottom piece and said large inner piece being joined below the top edge of the bottom piece measuring down roughly the length of the short side of a card, said bottom piece and said larger inner piece being joined at the right edge of said apparatus for card arrangement, said top and bottom pieces being joined at the top edge of said apparatus for card arrangement, said top, smaller inner, larger inner, and bottom pieces being joined at the bottom and left outer edges of said apparatus for card arrangement, means for securely arranging said cards to maximize the exposed surface area of said cards while occupying a footprint with an area roughly defined by a square with dimensions roughly equal to the length of the long edge of a card, means for securely arranging said cards to ensure at least a portion of all said cards is always visible from a single viewing angle, means for securely arranging said cards to prevent cards from sliding around becoming hidden behind other cards, whereby (a) said top card in landscape orientation, said bottom card in landscape orientation, and said top card in portrait orientation are seamlessly arranged in a single portrait orientation double landscape orientation arrangement when all said cards are inserted in said apparatus for card arrangement, (b) during interaction with the said apparatus for card arrangement the user can quickly discern card types from large surface area exposure of said cards and efficiently grip and remove said cards and, (c) said apparatus for card arrangement eliminates cheap lining materials in construction in order to allow said user of said apparatus for card arrangement to realize a lower cost of wallet ownership over the life of the wallet.

2. An apparatus for card arrangement comprising:

a top piece which will cover roughly the right half of a card in portrait orientation when said card in portrait orientation is inserted in said apparatus for card arrangement, a small inner piece which underlies roughly the bottom half of said card in portrait orientation, and overlies roughly the right half of a bottom card in landscape orientation when said bottom card in landscape orientation is inserted in said apparatus for card arrangement, said top and small inner pieces being joined at the right and bottom outer edges of said apparatus for card arrangement, a large inner piece which underlies said bottom card in landscape orientation when said bottom card in landscape orientation is inserted in said apparatus for card arrangement, and overlies roughly the bottom half of a top card in landscape orientation when said top card in landscape orientation is inserted in said apparatus for card arrangement, said top, small inner, and large inner pieces being joined at the right and bottom outer edges of said apparatus for card arrangement, said large and small inner pieces being joined at the top edge of said large and small inner pieces, a bottom piece which underlies said large inner piece and said top card in landscape orientation when said top card in landscape orientation is inserted in said apparatus for card arrangement, said bottom piece and said large inner piece being joined below the top edge of the bottom piece measuring down roughly the length of the short side of a card, said bottom piece and said large inner piece being joined at the left edge of said apparatus for card arrangement, said top and bottom pieces being joined at the top edge of said apparatus for card arrangement, said top, small inner, large inner, and bottom pieces being joined at the bottom and right outer edges of said apparatus for card arrangement, means for securely arranging said cards to maximize the exposed surface area of said cards while occupying a footprint with an area roughly defined by a square with dimensions roughly equal to the length of the long edge of a card, means for securely arranging said cards to ensure at least a portion of all said cards is always visible from a single viewing angle, means for securely arranging said cards to prevent cards from sliding around becoming hidden behind other cards, whereby (a) said top card in landscape orientation, said bottom card in landscape orientation, and said top card in portrait orientation are seamlessly arranged in a single portrait orientation double landscape orientation arrangement when all said cards are inserted in said apparatus for card arrangement, (b) during interaction with the said apparatus for card arrangement the user can quickly discern card types from large surface area exposure of said cards and efficiently grip and remove said cards and, (c) said apparatus for card arrangement eliminates cheap lining materials in construction in order to allow said user of said apparatus for card arrangement to realize a lower cost of wallet ownership over the life of the wallet.

* * * * *